United States Patent [19]

Kubo et al.

[11] Patent Number: 4,857,168

[45] Date of Patent: Aug. 15, 1989

[54] METHOD FOR HYDROCRACKING HEAVY FRACTION OIL

[75] Inventors: Junichi Kubo, Yokohama; Kenji Suzuki, Tokyo, both of Japan

[73] Assignee: Nippon Oil Co., Ltd., Tokyo, Japan

[21] Appl. No.: 146,234

[22] Filed: Jan. 20, 1988

[30] Foreign Application Priority Data

Mar. 30, 1987 [JP] Japan ..... 62-74273

[51] Int. Cl.[4] ..... C10G 65/12

[52] U.S. Cl. ..... 208/58; 208/56; 208/108; 208/112; 208/145; 208/251 H; 208/100

[58] Field of Search ..... 208/56, 145, 112, 108, 208/107, 58, 100, 251 H

[56] References Cited

U.S. PATENT DOCUMENTS

| | | | |
|---|---|---|---|
| 4,293,404 | 10/1981 | Farcasiu et al. | 208/56 |
| 4,465,587 | 8/1984 | Garg et al. | 208/112 |
| 4,592,830 | 6/1986 | Howell et al. | 208/112 |
| 4,640,762 | 2/1987 | Woods et al. | 208/56 |
| 4,640,765 | 2/1987 | Kubu | 258/56 |
| 4,661,241 | 4/1987 | Dabkowski et al. | 208/56 |

*Primary Examiner*—Anthony McFarlane

*Attorney, Agent, or Firm*—Bucknam and Archer

[57] ABSTRACT

A method for hydrocracking a heavy fraction oil characterized by cracking a heavy fraction oil in the presence of a hydrogen donating solvent and hydrogen gas and circulating a fraction having a specific boiling range as the circulating solvent through the cracking reactor whereby the formation of carbonaceous substances is greatly inhibited, the supply of a makeup hydrogen donating solvent is disposed with and the concentration of tetralin in the circulating solvent is maintained at a fixed or higher level.

3 Claims, 5 Drawing Sheets

METHOD FOR HYDROCRACKING HEAVY FRACTION OIL

BACKGROUND OF THE INVENTION

1. Field of the Invention

The present invention relates to a method for hydrocracking a heavy fraction oil, particularly that containing at least 1.0 wt. % of asphaltene, using a hydrogen donating solvent.

2. Description of the Prior Art

The hydrogenolysis of a heavy fraction oil has recently been increasingly used. Thus, there have been proposed many method for thermocracking, catalytic cracking, hydrogenolysis, etc.

The term "cracking" used herein is intended to obtain light fraction oils including naptha, gasoline, kerosene and gas oil fractions by hydrocracking the heavy fraction oil.

The most serious and troublesome problems raised by the cracking of a heavy fraction oil are, in general, the formation of carbonaceous substances and the clogging of various parts of an apparatus for the cracking with the carbonaceous substances. Further, the serious problem caused by the catalytic cracking of the heavy fractopm oil is the decrease in catalytic activity of a catalyst used. Still further, the cracking of the heavy fraction oil raises an economic problem as to an increase in amount of hydrogen consumed. These problems are rendered more serious as the fraction oil to be cracked is heavier and the cracking proceeds farther.

One of methods for solving these problems is a method comprising the use of a hydrogen donating solvent (For example, U.S. Pat. No. 4,430,197). It is well known that compounds, such as tetralin (tetrahydronaphthalene), obtained by hydrogenating polycyclic aromatic compounds, serve as a hydrogen donor and that catalysts are not necessarily required for the hydrogenolysis of a heavy fraction oil with the use of such a hydrogen donating solvent, and these reaction proceeds under a comparatively low hydrogen pressure (For example, U.S. Pat. No. 4,294,686 and Oil & Gas Journal, Nov. 22, 1982, pp. 111–116). The above methods so known have very often been attempted to be used industrially (For example, U.S. Pat. No. 2,953,513). It is also known that such hydrogen donating substances are contained in thermocracked oils, catalytically cracked oils, hydrocracked oils and the like and function, per se, as an effective hydrogen donor (For example, U.S. Pat. No. 3,970,545).

These known methods, however, will not produce fully stable cracked products and will contain problems as to the formation of carbonaceous substances, and the like. In order to solve these problems, it is known as effective to have a suitable catalyst coexist with a hydrogen donating solvent (Japanese Pat. Appln. Laid-Open Gazette Nos. 61-62591, 61-130394, 61-136591 and U.S. Pat. No. 4,690,765.

It has been found by the present inventors that the combined use of a hydrogen donating solvent such as tetralin, and a catalyst capable of hydrogenolysis will provide the following advantages.

(1) The formation of carbonaceous substances is inhibited.

The formation of carbonaceous substances will be inhibited even by the use of a hydrogen donating solvent only. If a suitable catalyst, however, is used in combination with said solvent, the resulting cracked products will be hydrogenated and therefore stabilized whereby the formation of carbonaceous substances is greatly inhibited and troubles decrease which may otherwise be caused due to the clogging of a hydrocracking apparatus with the carbonaceous substances.

(2) A decrease in catalytic activity of the catalyst is lessened.

The most serious problem raised in the cracking of a heavy fraction oil using a suitable catalyst is a decrease in catalytic activity of the catalyst. In general, a heavy fraction oil contains asphaltene in which are contained heavy metals such as vanadium and nickel. When the heavy fraction oil is cracked, these heavy metals and carbonaceous substances will adhere to the surface of the catalyst whereby the catalyst decreases in catalytic activity. The coexistence of a hydrogen donating solvent such as tetralin in this case, will greatly lessen a decrease in catalytic activity of the catalyst.

If the catalyst used is highly capable of adhesion of heavy metals thereto at this point, the effects of the hydrogen donating solvent will be further increased.

(3) The cracking reaction may be carried out at lower pressures.

It is necessary to use a high hydrogen pressure, generally 100 atm. to 200 atm., in order to mainly prevent the catalyst from lowering in catalytic activity when cracking a heavy fraction oil in the presence of a suitable catalyst only. It is unnecessary, however, to use a high hydrogen pressure since hydrogen is supplied from a hydrogen donating solvent if the hydrogen donating solvent, such as tetralin, coexists in the system; in this case, 30 atm. to 150 atm. is sufficient as the hydrogen pressure.

(4) The amount of hydrogen consumed may be decreased.

According to the results of experiments made by the present inventors, it has been found that the cracking of a heavy fraction oil in the presence of a catalyst without a hydrogen donating solvent is different in cracking and hydrogenating reactions taking place in the cracking from the cracking of the same heavy fraction oil in the presence of the hydrogen donating solvent without the catalyst, and that both of the crackings are greatly different from each other in the amount of hydrogen consumed even in cases where the same cracking ratio or rate is obtained by each of said two cracking reactions. The combined use of the hydrogen donating solvent and the catalyst enables effective hydrogenolysis to be attained with a minimum amount of hydrogen consumed and without unnecessary hydrogenation.

It is also known that, in general, a fraction containing hydrogen donating solvents is recovered from a distillate from fractionation and the fraction so recovered is used for recirculation (Japanese Pat. Appln. Laid-Open Gazettes Nos. 61-62591 and 61-130394).

The method proposed in these Gazettes, however, raise the following problems.

(1) The starting oil is cracked, and the resulting hydrocarbon having the same boiling point as the circulating solvent is incorporated into the circulating solvent and accumulated therein whereby the concentration of tetralin in the circulating solvent decreases.

(2) In a case where a heavy fraction oil is cracked using tetralin, the tetralin and naphthalene are partly lost by carrying out distillation operation for recovering the circulating solvent. Further, the tetralin is converted to decalin, methylindane, methylnaphthalene, butylbenzene and the like during the cracking operation. The compounds produced by the conversion are discharged from the system thereby to make a partial loss of tetralin. The total amount of tetralin lost due to the distillation operation and the conversion will be less, not nullified, by suitable selection of a catalyst and cracking reaction conditions used. Accordingly, if tetralin or naphthalene (to be converted to tetralin by hydrogenation) is not produced from the starting oil during the cracking operation, the amount of tetralin or naphthalene originally existing in the system will gradually decrease. To compensate this decrease, the amount of makeup tetralin or naphthalene supplied from outside of the system will be large.

SUMMARY OF THE INVENTION

An object of the present invention is to provide a method for a cracking heavy fraction oil containing at least 1.0 wt. % of asphaltene in the presence of a hydrogen donating solvent, characterized in that the formation of carbonaceous substances is greatly inhibited and problems as to the circulation of the hydrogen donating solvent are solved.

The present inventors made various studies and then found the following.

(1) As one of characteristics, tetralin and naphthalene are formed as cracked products in cases where a heavy fraction oil is cracked in the presence of a catalyst capable of hydrogenation, a hydrogen donating solvent and hydrogen gas. Although tetralin and naphthalene are still produced even in the absence of a catalyst, they will be produced in greater amounts in the presence of the catalyst.

(2) The hydrocarbons (produced by the cracking and hereinafter referred to as "other hydrocarbons") incorporated in the circulating solvent are further cracked, treated in a fractionating apparatus and then discharged as a light fraction oil from the system.

(3) There exists an equilibrium concentration at which the amount of "other hydrocarbons" incorporated in the circulating solvent is equal to the amount of a light fraction oil produced by cracking the "other hydrocarbons" and discharged from the circulating solvent.

(4) When the boiling range of the circulating solvent is allowed to be wide, the concentration of the "other hydrocarbons" in the circulating solvent becomes large, whereas the concentration of tetralin therein inversely becomes small.

(5) It is attained by limiting the boiling range of the circulating solvent to keep the concentration of tetralin therein at a certain high level.

(6) In case where the cracking is carried out while maintaining the concentration of tetralin in the circulating solvent at a fixed level, the loss of tetralin caused by its discharge from the system is compensated for by tetralin and naphthalene produced from the starting heavy fraction oil by cracking, resulting in no apparent loss of tetralin.

It has thus been found that the heavy fraction oil is cracked using a catalyst capable of hydrogenation in the presence of a hydrogen donating solvent and hydrogen gas and a fraction having a specific boiling range is circulated whereby the formation of carbonaceous substances is greatly inhibited, the supply of a makeup hydrogen donating solvent can be dispensed with and the concentration of tetralin in the circulating solvent is maintained at a fixed or higher level. The method for hydrocracking heavy fraction oils of the present invention is based on the above finding or discovery.

The method of the present invention comprises cracking (a) a starting heavy fraction oil in the presence of (b) a hydrogen donating solvent and (c) hydrogen gas using a catalyst capable of hydrogenation in a cracking reactor, hydrogenating the fractions obtained by the cracking in a hydrogenating reactor, separating the thus hydrogenated fractions in a liquid and gases, fractionating the thus separated liquid in a distillation apparatus to obtain fractions including a specific fraction in which at least 90 wt. % is boiling in the range of 150°-250° C., at least 60 wt % is boiling in the range of 190°-230° C. and at least 30 wt. % is tetralin, circulating said specific fraction as the circulating solvent through said cracking reactor with or without replenishment of any hydrogen donating solvent in an amount by weight of 0.7% of the starting oil thereby to obtain a hydrocracked oil.

The starting heavy fraction oils used in the present invention are those containing at least 1.0 wt. %, preferably 5-30 wt. %, of asphaltene and at least 50 wt. % of a fraction boiling at 350° C. or higher, and they include residual oils obtained by the distillation of crude oils at atmospheric or reduced pressure, oils obtained from coal, oil sand, oil shale, bitumen or the like, and mixtures of said various heavy fraction oils.

The hydrogen donating solvents used in the present invention may be hydrides of polycyclic aromatic hydrocarbons. The polycyclic aromatic hydrocarbons include bicyclic to hexacyclic, preferably bicyclic to tetracyclic, aromatic hydrocarbons and derivatives thereof such as naphthalene, anthracene, phenanthren, pyrene, naphthacene, chrysene, benzopyrene, perylene, picene and derivatives thereof, which may be used individually or jointly. In addition, the hydrides of hydrocarbon oil boiling in the range of 150°-500° C. and containing at least 20 wt. % of said polycyclic aromatic hydrocarbons, may also be used as a hydrogen donating solvent, and the hydrocarbon oils include cycle oils in an apparatus for catalytic cracking (FCC), bottom oils in a catalytic reforming apparatus, bottom oils in a thermocracking apparatus and other oil products obtained from petroleum refining plants as well as coal-derived products such as tar oil, anthracene oil, creosote oil, coal liquefied oil, and products obtained from tar sand, oil shale, bitumen and the like.

The hydrocarbon oils preferably used in the present invention include FCC cycle oils containing naphthalene, anthracene and the like, and bottoms obtained by thermocracking and reforming naphtha.

In the present invention, although the polycyclic aromatic hydrocarbons and hydrocarbon oils may be hydrogenated prior to being charged into the reactor, this is not necessarily required since the hydrocarbons and oils are otherwise hydrogenated to produce hydrogen donating solvents because of the presence of hydrogen gas and catalysts in the reactor.

In addition, in the present invention, if a circulating solvent containing hydrogen donating solvents is stored in a circulating solvent storage tank provided at the passage of circulation, the circulating solvent may be used as the hydrogen donating solvent.

The catalysts in the cracking reactor used in the present invention are not particularly limited, but it is desirable that they to have a demetallizing function and should preferably be such that they will be comparatively little degraded in catalytic activity due to the accumulation of heavy metals such as vanadium and nickel. These catalysts include the oxides and sulfides of Group VIII metals of the Periodic Table such as nickel and cobalt as well as of Group VIB metals of the Periodic Table such as molybdenum and tungsten, each carried on alumina, silica, silicaalumina, alumina-boria, silica-alumina-magnesium, silicaalumina-titania and inorganic substances such as natural and synthetic zeolites.

The solid catalyst particles are required to have such a shape that they will not accompany the flow of the liquid discharged from the cracking reactor. They may be spherical or extrudate in shape and may be formed by extrusion molding or compression molding. It is desirable that these catalysts have a particle size of 0.1–10 mm, preferably 0.2–5 mm.

BRIEF DESCRIPTION OF THE DRAWINGS

A better understanding of the method of the present invention may be had from a consideration of the following detailed description, taken in conjunction with the accompanying drawings, in which.

DETAILED DESCRIPTION OF THE INVENTION

Figure 1:
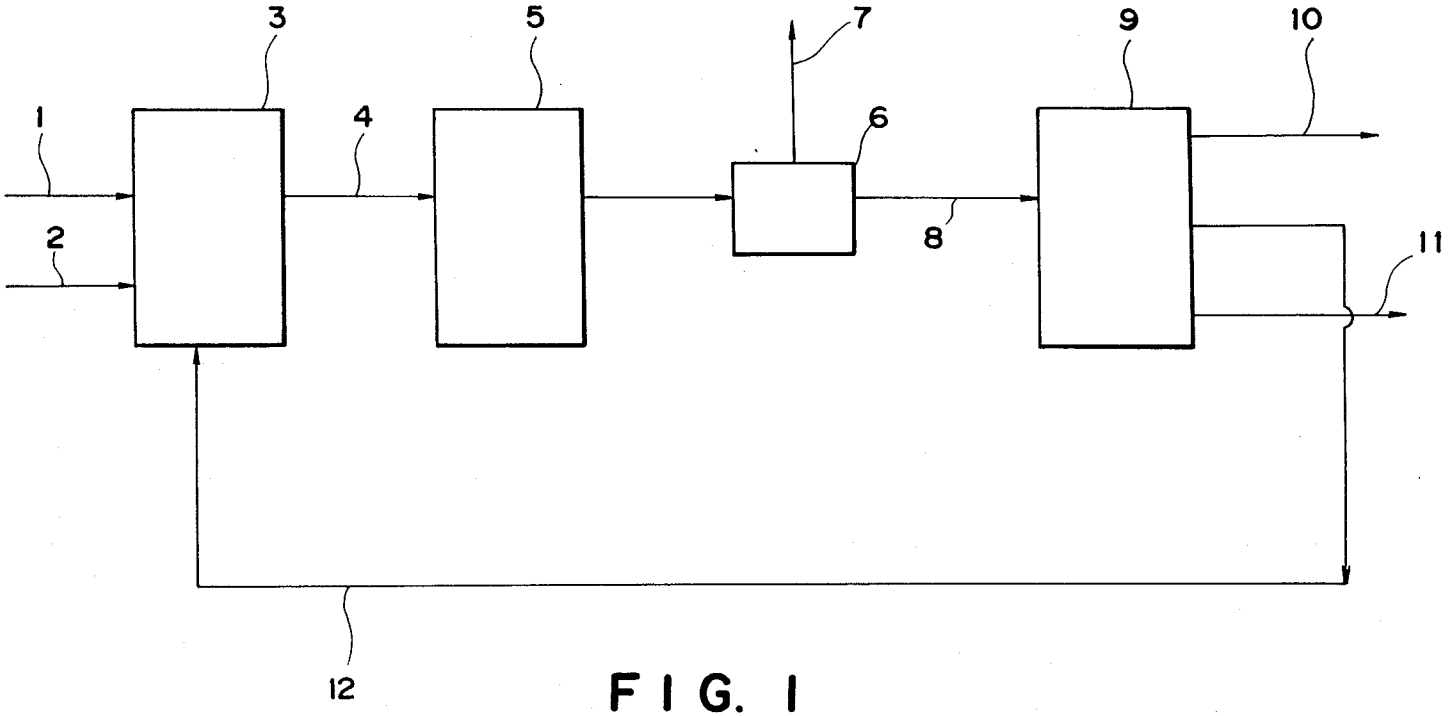
FIG. 1 is a block diagram illustrating a method for cracking heavy fraction oils according to the present invention.

Referring now to FIG. 1, a starting heavy fraction oil 1, a hydrogen-containing gas 2 and a circulating solvent 12 containing a hydrogen donating solvent, are introduced into a cracking reactor 3. The cracking reactor 3 holds therein a solid catalyst in the form of a catalyst-filled layer and is maintained at a reaction temperature of 380°–470° C., preferably 390°–440° C., and a reaction pressure of 30–150 $Kg/cm^2.g$, preferably 40–100 $Kg/cm^2.g$.

The heavy fraction oil 1 is cracked in the cracking reaction 3, during which at least 50 wt. % of heavy metals such as vanadium and nickel contained in the heavy fraction oil is removed therefrom by attaching the metals to the solid catalyst in the cracking reactor. The hydrocracked oil obtained from the heavy fraction oil, the hydrogen-containing gas and the circulating solvent containing the hydrogen donating solvent, are introduced from the cracking reactor 3, without any separation treatment, via a pipe 4 into a hydrogenating reactor 5.

The hydrogenating reactor 5 holds therein a solid catalyst in the form of a filled layer and is maintained at a reaction temperature of 320°–440° C. and a reaction pressure of 30–150 $Kg/cm^2.g$. In the hydrogenating reactor, the cracking reaction still proceeds, but the main reactions include the hydrogenation, desulfurization and denitrification of the cracked oils from the cracking reactor 3, the hydrogenation of the used hydrogen donating solvents and the hydrogenation of carbon precursors produced in the cracking reactor 3. The carbon precursor is hydrogenated in the hydrogenating reactor 5 to be converted to a toluene-soluble substance, resulting in the production of substantially no carbonaceous substances.

The liquid and gases from the hydrogenating reactor 5 are separated into the liquid and the gases in a liquid-gas separator 6. The gases so separated contain hydrogen sulfide, ammonium sulfide and the like are subjected to appropriate washing or scrubbing treatment, after which a part of the washed gases is discharged from the system while another part thereof is reused as the circulating gases. The liquid 8 which has been separated from the gases 7 in the liquid-gas separator 6, is introduced into a fractionating apparatus 9 where a circulating solvent fraction 12 is separating from a light fraction oil 10 and a heavy fraction oil 11 and then circulating again to the cracking reactor 3. A solvent storage tank may be provided at the passage of said circulating solvent fraction.

This circulating solvent fraction is required to be such that at least 90 wt. % of the solvent fraction is a hydrocarbon fraction boiling in the range of 150°–250° C., at least 60 wt. % of the solvent fraction is a hydrocarbon fraction boiling in the range of 190°–230° C. and at least 30 wt. % of the solvent fraction is tetralin. The amount of circulating solvent fraction circulated is that expressed by a ratio of 0.1–2.0 (wt./wt. starting oil), particularly preferably 0.1–1.2 (wt./wt. starting oil). If the amount of circulating solvent fraction circulated is smaller than that so expressed, the formation of carbonaceous substances will be remarkable whereby develop troubles such as the clogging of the hydrocracking apparatus with the carbonaceous substances and the increased lowering in catalytic activity of the catalyst. If, on the other hand, the amount of liquid circulated is too much, the apparatus will be required to be a large-scale one and the amount of heat required for heating will be large, this being economically undesirable.

A starting heavy fraction oil is cracked in the presence of a hydrogen donating solvent, a hydrogencontaining containing gas and a catalyst capable of hydrogenation according to the present invention, whereby tetralin, naphthalene and the like are produced from the starting oil in a total amount of at least 0.5 wt. % thereof. The amount of these hydrogen donating solvents produced from the starting oil may be adjusted by changing the cracking reaction conditions and fractionator conditions, and it will also very depending on the kind of starting oil used.

In the present invention, it is generally unnecessary to replenish hydrogen donating solvents from outside the system since the loss of the solvents caused by discharging to outside the system can be compensated by forming hydrogen donating solvents such as tetralin and naphthalene as the cracked products obtained from a starting heavy fraction oil and circulating a fraction boiling in the specific ranges (this fraction so circulated being a circulating solvent fraction). Depending on the kind of a starting heavy fraction oil, the starting oil may be incorporated with hydrogen donating solvents in an amount of not higher than 0.7 wt. %, preferably not higher than 0.5 wt. %, of the starting oil.

In the cracking reactor according to the present invention, the tetralin evolves hydrogen therefrom and is partly converted to naphthalene while converting part of the tetralin to decalin, methylindane, methylnaphthalene and the like as by-products. These by-products may be inhibited from forming by using appropriate cracking reaction conditions and, therefore, they will not accumulate in the circulating solvents. The naphthalene in the circulating solvents may be limited to 5 wt. % or lower in concentration since it is hydrogenated under the action of the catalysts and converted to tetralin in the cracking reactor and hydrogenating reactor.

It is necessary that a catalyst capable of hydrogenation be present in the cracking reactor used in the present invention. The catalyst may usually be a solid one. In a case where the solid catalyst is used in the present invention, it is not desirable that the catalyst be discharged together with the flow of the liquid from the reactors since it is difficult to recover the thus discharged catalyst at the subsequent stages and maintain the catalyst concentration at a desired high level whereby the effective use of the catalyst is not attained. It is effective to use a fixed bed, moving bed, fluid bed (dense fluid bed) or the like in order to retain a solid catalyst in the reactors. In cases where the fixed or moving bed is used, it is effective to maintain a liquid linear velocity of at least 2 cm/sec. Further, it is particularly effective to employ an inner natural liquid circulation system as indicated in Japanese Pat. Appln. Laid-Open Gazette No. 61-235492.

Figure 2:
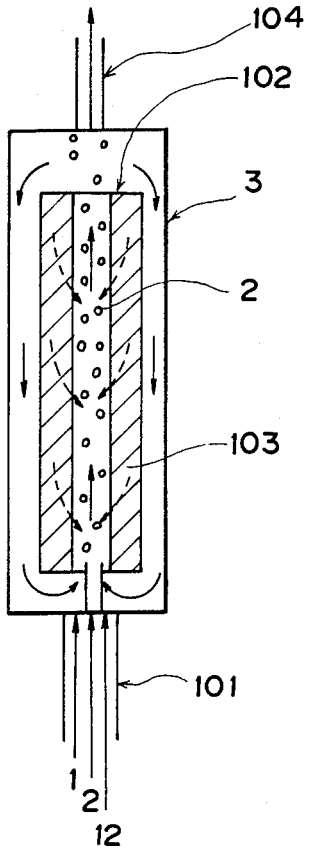
FIG. 2 is a schematic diagram showing the longitudinal section of a cracking reactor used in the present invention.

The inner natural circulation system will be explained below with reference to FIG. 2.

A starting oil 1, a hydrogen donating solvent and a hydrogen-containing gas 2 are introduced through an introduction pipe 101 provided on the lower part of the cracking reactor 3. The interior of the cracking reactor 3 is vertically divided into two parts by the cylindrical partition 102 including a solid catalyst 103 housed therein, and the aforesaid two parts communicated with each other on the upper and lower parts of the partition 102. It is preferable for the introduced hydrogen-containing gas 2 to be introduced toward the inner part of the cylindrical partition 102 so as not to flow into the outside portion of the partition 102. The same is also applied to the heavy fraction oil and the hydrogen donating solvent. The foamy hydrogen-containing gas 2 ascends the interior of the partition 102.

With such construction, the fluid in the cracking reactor 3 is circulated in the direction of an arrow shown in the figure due to the intra-reactor pressure unbalance caused by the small specific gravity of a region in which the hydrogen-containing gas 2 exists.

A part of the above-described circulating fluid is capable of passing through the solid catalyst-housed partition 102 from the outside of the partition 102 (the outer side of the partition in which the hydrogen-containing gas 2 is substantially not existent) to the inside thereof (the inner side of the partition in which the gas 2 is existent) in the direction shown by an arrow (dotted line). The mount of the fluid passed changes depending on the void ratio of the catalyst-filled partition or the pressure difference between the outside and inside of the partition 102. The void ratio of the partition 102 preferably ranges from 5 to 95% in general. The void ratio used herein is the proportion of the space existing in unit volume to the unit volume.

By arranging a cylinder as the partition 102 in the cracking reactor 3, it is possible to yield a circulating flow inside the reactor, assure a required flow velocity, and avoid any blocking in the cracking reactor 3 caused by carbonaceous substances therein.

The hydrogen-containing gas 2 ascends in the cylindrical partition 2 and is discharged from the outlet pipe 104, while the fluid circulates in the cracking reactor 3 and, after a prescribed residence time, is discharged from the outlet pipe 104. Accordingly, the fluid which resides for a prescribed period of time under prescribed temperature and pressure conditions can be cracked and made lighter fractions.

The partition for housing a solid catalyst according to the present invention is porous as a whole, a part or the whole of the porous being composed of the solid catalyst having a hydrogenation function, while it is generally porous plain plate- or curved plate-shaped as a whole. A part or the whole of the plate is formed by an assembly of solid catalyst particles having a hydrogenation function. The partition may be illustrated by those prepared by housing at least one kind of particulate catalyst selected from extrusion molded catalyst, spherical catalyst and compression molded catalyst, in a container made of a metal mesh, punching metal or the like, and may also be illustrated by an assembly of catalyst particles bonded to each other with a bonder.

The thickness of the partition for housing a solid catalyst is 1/100 to 2/5, preferably 1/10 to $\frac{1}{3}$, of the inner diameter of the reaction reactor.

The sizes of openings of the metal mesh and punching metal for housing a solid catalyst are such that solid catalyst particles do not pass through the openings and the fluid may sufficiently contact with the catalyst particles.

The amount of catalyst used in the present invention ranges from 1/100 to 1/1.5, preferably 1/50 to $\frac{1}{2}$, of the internal volume of the cracking reactor.

The solid catalyst is not particularly limited only if it is one having a hydrogenation function such for example as hydrocracking, hydrometallization, hydrodesulfurization or hydrodenitrification. But, from the viewpoint of long-term operation, the preferable catalyst is one which will not remarkably decrease in activity due to vanadium, nickel and the like contained in starting oils even if it has originally low activity.

For example, there can be used the same catalysts as employed in a heavy fraction oil treating process such as hydrocracking, hydrodemetallization or hydrodesulfurization for heavy fraction oils, or there can also be employed used catalysts.

In addition, it is possible to add a small quantity of a fresh catalyst to the above-described catalysts or to also use catalysts having relatively low activity instead of the above-described used catalysts. The solid catalysts include the oxides or sulfides of a Group VIII metal such as nickel or cobalt or of a Group VI B metal such as molybdenum or tungsten, the metal oxides or sulfides being carried on an inorganic substance such as alumina, silica, silica-alumina, alumina-boria, silica-alumina-magnesia, silica-alumina-titania, or natural or synthetic zeolite.

Although the solid catalyst is not particularly limited in shape, for example an extrusion molded catalyst, a spherical catalyst or a compression molded catalyst may be used.

The diameter of the catalyst particle ranges from 0.1 to 10 mm, preferably 0.2 to 5 mm.

The operating conditions used in the present invention are as follows: reaction temperature, 380 to 470° C.; reaction pressure, 30 to 150 kg/cm$^2$.g varying depending on the kind of a hydrogen-containing gas used; residence time of starting heavy fraction oil in the cracking reactor, preferably 0.2 to 10 hours; circulating flow speed of the fluid in the cracking reactor, at least 1 cm/sec., preferably 5 to 100 cm/sec.

The hydrogenating reactor according to the present invention is used in the form of a general fixed bed, and the flow of the fluid in said reactor may be either an ascending one or a descending one. In the hydrogenating reactor, the cracking reaction still proceeds, but the main reactions include reactions of hydrogenation, desulfurization and denitrification of the cracked oils as well as reactions of hydrogenation of the hydrogen donating solvents and carbon precursors (expressed as toluene-insolubles) to solubilize the precursors. Thus, the catalysts used in the hydrogenating reactor are required to have a hydrogenation function and may have the same shape as generally used in fixed-bed reactors. In addition, they may generally have the same composition as those used in hydrogenating treatments such as hydrolysis and hydrodesulfurization.

In order to separate the circulating solvent fraction from the resulting reaction products, a usual fractionator may be used. The fractionation may be carried out using two (first and second) fractionators, the first fractionator being used for separation of lighter fraction oils and the second one for separation of heavy fraction oils, or may be carried out using a single fractionator, a circulating solvent fraction being withdrawn from the halfway of the single fractionator.

The effects obtainable by the practice of the present invention are as follows.

In cases where a heavy fraction oil is cracked in the presence of a hydrogen donating solvent, a hydrogen-containing gas and a catalyst capable of hydrogenation as indicated in the hydrocracking method of the present invention, the formation of carbonaceous substances is greatly inhibited, and the loss of the hydrogen donating solvent caused by the discharge thereof from the system in inhibited whereby the replenishment of makeup solvent is dispensed with.

The present invention will be better understood by the following Examples and Comparative Examples.

EXAMPLE 1

An Arabian reduced-pressure heavy residual oil having the properties indicated in Table 1 was cracked by the method of FIG. 1 and under the conditions indicated in Table 2. Tetralin was used as the main hydrogen donating solvent. The cracking reactor used was the one of internal natural circulation type (Refer to U.S. Pat. No. 4,460,765 for detailed information), the hydrogenating reactor used was of the downward current fixed bed type. The fractionators of the double-stage type were used to separate the lighter fraction oil at the first stage and separate the heavy fraction oil at the second stage while recovering as the second-stage top the circulating solvent fraction boiling in the range shown in FIG. 3.

The catalyst used in the cracking reactor was such that cobalt (4.0 wt. %) and molybdenum (11.5 wt. %) were supported on a silica-alumina carrier (porosity 53 c.c./g, surface area 190 $m^2/g$, average pore radius 58 Å) and extrusion molded to form 1/16 inch extrusion molded catalyst particles which were housed in an annular cylindrical punching metal.

The catalyst used in the hydrogenating reactor was 1/32 inch extrusion molded catalyst particles in which cobalt (4.1 wt. %) and molybdenum (13.0 wt. %) were supported on a silica-alumina carrier (porosity 49 c.c./g, surface are 212 $m^2/g$, average pore radius 58 Å). The operation was continued at a cracking rate of 85 wt. % for 25 days to find changes in composition of the circulating solvent (FIG. 4) and changes in amount of the tetralin in the system (FIG. 5).

COMPARATIVE EXAMPLE 1

The procedure of Example 1 was followed except that the circulating solvent herein used had a boiling range which was different from that of the circulating solvent used in Example 1.

Figure 3:
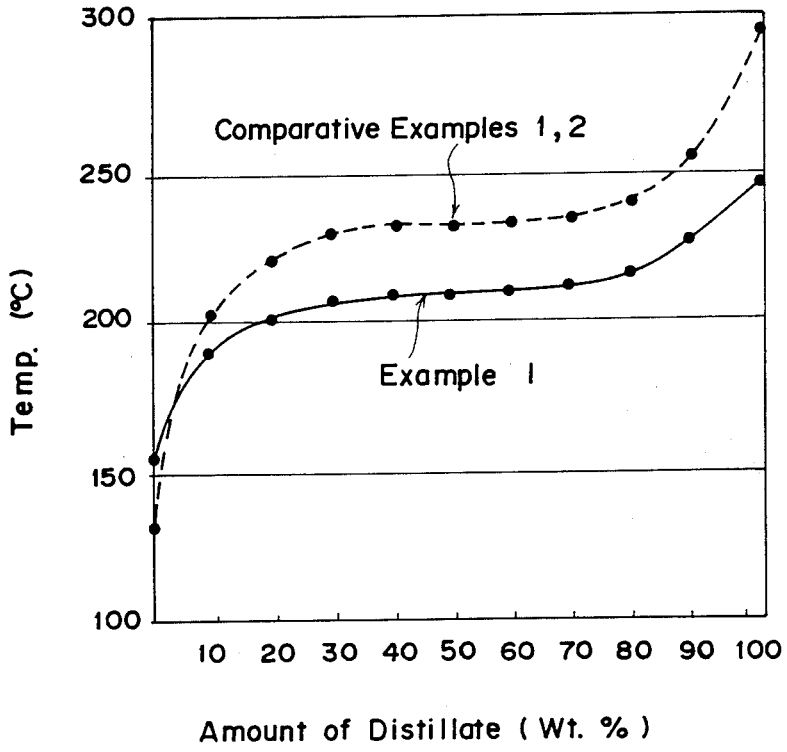
FIG. 3 illustrates the distillation curves of circulating solvents.

The properties of the starting oil and hydrocracked oils are indicated in Table 1, the reactional conditions used in the cracking and hydrogenating reactors are indicated in Table 2, and the distillation curves of the circulating solvents, in comparison with that of Example 1, are shown in FIG. 3. In addition, FIG. 4 indicates the changes in tetralin concentration with the lapse of time of operation in the circulating solvents, and FIG. 5 shows the changes in tetralin concentration with the lapse of time of operation in the system in comparison with those exhibited in Example 1.

COMPARATIVE EXAMPLE 2

The procedure of Example 1 was followed except that the circulating solvent used herein had the same boiling range as that used in Comparative Example 1 and the cracking reactor contained no catalyst. The test results are shown, in comparison with those in Example 1 and Comparative Example 1, in Tables 1 and 2.

TABLE 1

| Properties of Starting Oil and Product Oil | Starting Oil | Product Oil Ex. 1 | Product Oil Com. Ex. 1 | Product Oil Com. Ex. 2 |
|---|---|---|---|---|
| Specific gravity ($d_4^{15}$) | 1.030 | 0.930 | 0.933 | 0.935 |
| Viscosity (cSt) | 145.3 (@ 160° C.) | 28.31 (@ 50° C.) | 30.15 (@ 50° C.) | 37.25 (@ 50° C.) |
| Residual carbon (wt. %) | 22.52 | 8.35 | 8.71 | 9.13 |
| Softening point (°C.) | 43.4 | — | — | — |
| Asphaltene (wt. %) (Pentane-insolubles) | 13.3 | 3.0 | 3.2 | 6.1 |
| Elemental analysis (wt. %) | | | | |
| S | 4.79 | 0.71 | 0.73 | 1.37 |
| N | 0.4 | 0.14 | 0.15 | 0.21 |
| C | 84.5 | 86.9 | 87.1 | 85.8 |
| H | 10.3 | 11.9 | 12.02 | 11.0 |
| H/C (Atomic ratio) | 1.46 | 1.64 | 1.66 | 1.54 |
| Metal (ppm) | | | | |
| V | 143 | 21 | 22 | 70 |
| Ni | 46 | 15 | 15 | 31 |
| Cracking ratio (wt. %) | — | 84.9 | 83.7 | 82.5 |

TABLE 2

| Item | Cracking reactor | | | Hydrogenating reactor | | |
|---|---|---|---|---|---|---|
| | Ex. 1 | Com. Ex. 1 | Com. Ex. 2 | Ex. 1 | Com. Ex. 1 | Com. Ex. 2 |
| Reaction temp. (°C.) | 437 | 437 | 437 | 370 | 370 | 370 |
| Reaction pressure ($kg/cm^2 \cdot g$) | 80 | 80 | 80 | 80 | 80 | 80 |
| LHSV ($hr^{-1}$) | 0.4 | 0.4 | 0.4 | 0.25 | 0.25 | 0.25 |
| Amount of fluid circulated (wt./wt. starting oil) | 1.1 | 1.1 | 1.1 | 1.1 | 1.1 | 1.1 |
| Amount of residual oil fed (g/hr) | 700 | 700 | 700 | — | — | — |

Figure 4:
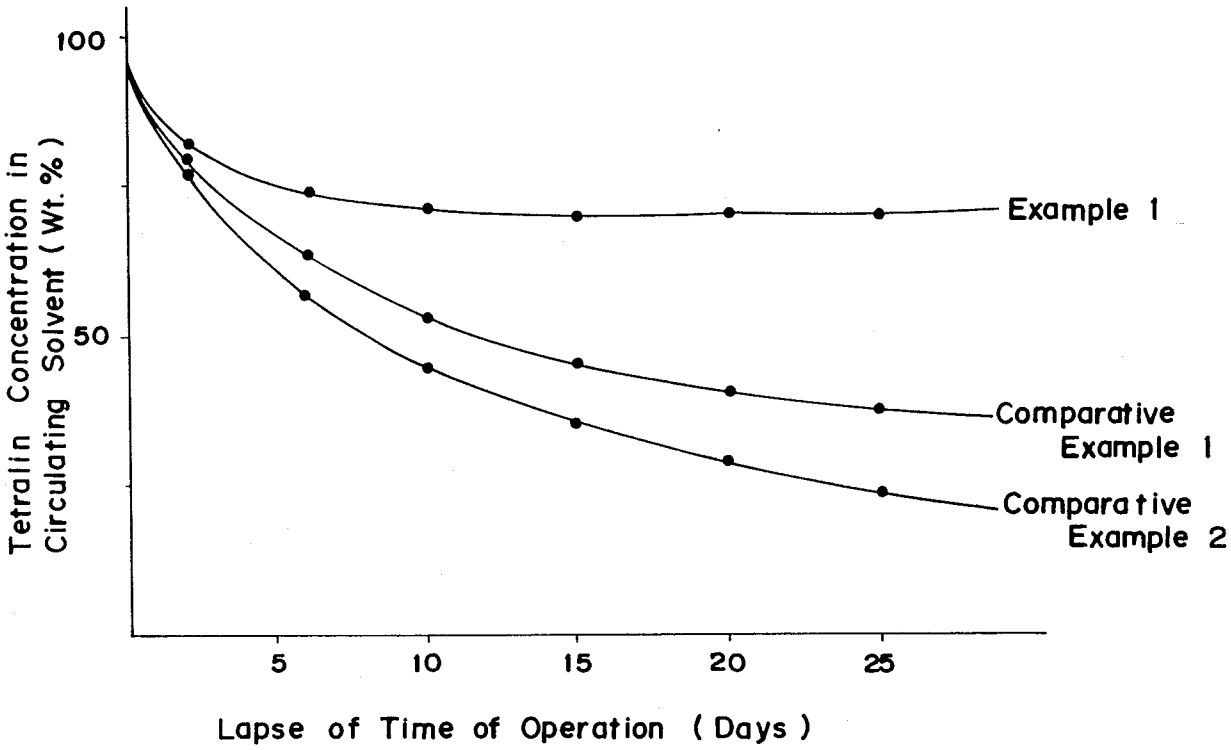
FIG. 4 illustrates changes in concentration of tetralin in circulating solvents with the lapse of time in the course of cracking operation.
Figure 5:
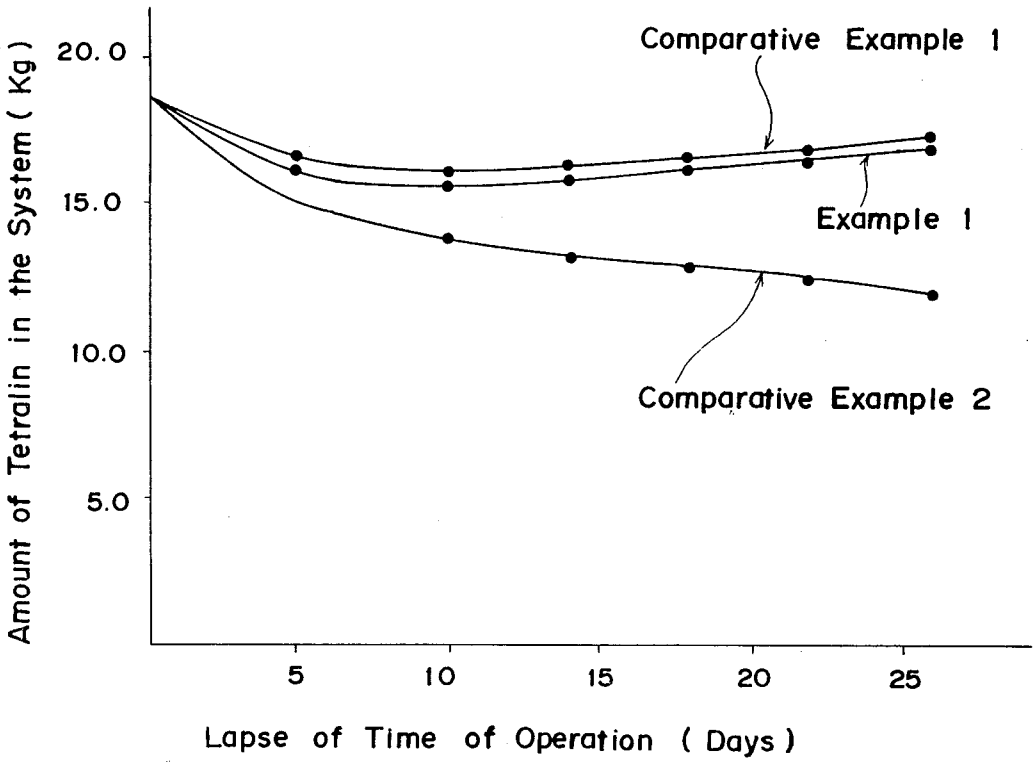
FIG. 5 illustrates changes in amount of tetralin in the course of cracking operation.

The information obtained from FIGS. 3-5 is as follows.

In cases where a circulating solvent having a broad boiling range is used (Comparative Examples 1 and 2), the tetralin concentration will gradually decrease with the lapse of time of operation, whereas in cases where a circulating solvent having a narrow boiling range is used (Example 1), the tetralin concentration in the solvent will decrease at the initial stage and then become constant. This indicates that in the case of the narrow boiling range, the amount of "other hydrocarbons" which invade to the circulating (or recycle) solvent is small and consequently an equilibrium concentration at which said amount of "other hydrocarbons" incorporated in the circulating solvent is equal to the amount of lighter hydrocarbons exhausted by further cracking the "other hydrocarbons" becomes low (equilibrium concentration of tetralin becoming high). It can be seen that the equilibrium concentration of tetralin in the circulating (or recycle) solvent is about 70 wt. % in Example 1. On the other hand, in the case of the broad boiling range, the tetralin concentration in the circulating solvent will continue to decrease since the equilibrium concentration is kept at a low level (FIG. 4).

Further, the amount of tetralin in the system will not decrease in Example 1 and Comparative Example 1, but it will decrease with the lapse of time of operation in Comparative Example 2. In Example 1 and Comparative Example 1, tetralin and naphthalene are produced from the starting oil in an amount enough to make up for the amount of tetralin and naphthalene discharged as the loss from the system since the starting oil is cracked in the presence of both the hydrogen donating solvent and the catalyst, resulting in that the amount of tetralin in the system decrease during a short time just after the start of the cracking operation and does not decrease after the lapse of said short time. In Comparative Example 2, on the other hand, tetralin and naphthalene are produced in a less amount than in Example 1 and Comparative Example 1 since the crack is carried out in the presence of the hydrogen donating solvent only.

In cases where a heavy fraction oil is cracked in the presence of both the catalyst and tetralin as mentioned above, it is possible to maintain the tetralin concentration in the circulating solvent at a predetermined level without decreasing the amount of tetralin in the system by using a circulating solvent having its boiling range narrowed to a certain extent. This enables the application of a hydrogen donating solvent to petroleumbased heavy fraction oils, which application has heretofore been considered difficult.

What is claimed is:

1. A method for hydrocracking a heavy fraction oil which consists of the steps of:

cracking a heavy fraction oil containing 1% up to 30% of asphaltene and at least 50% of a fraction of boiling point at least 350° C. in the presence of a circulating solvent comprising a hydrogen donating solvent, hydrogen gas and a catalyst capable of hydrogenation in a cracking reactor at a temperature of 380° C.-470° C., at a pressure of 30-150 $kg/cm^2.g$;

hydrogenating the fractions obtained by the cracking of said heavy fraction oil, in presence of a hydrogenating catalyst in a hydrogenating reactor at a temperature of 320°-440° C. and at a pressure of 30-150 $kg/cm^2.g$;

separating the thus hydrogenated fractions into a liquid and gases in a separator, fractionating the thus separated liquid in a distillation apparatus to obtain a specific fraction in which at least 90 wt. % is boiling in the range of 150°-250° C., at least 60 wt. % is boiling in the range of 190°-230° C. and at least 30 wt. % is tetralin, circulating said specific fraction as the circulating solvent through said cracking reactor, in the absence of added hydrogen donating solvent.

2. The method according to claim 1, wherein said catalyst in the cracking reactor is a solid catalyst capable of demetrallization.

3. The method according to claim 1, wherein said catalyst in the cracking reactor and said catalyst in the hydrogenating reactor are both used in the form of a packed bed.

* * * * *